US011377295B2

(12) United States Patent
Kim et al.

(10) Patent No.: US 11,377,295 B2
(45) Date of Patent: Jul. 5, 2022

(54) PACKAGING ASSEMBLY

(71) Applicants: Ozkor Pty. Ltd, Blacktown (AU); CAPRAL LIMITED, Bundamba (AU)

(72) Inventors: In Soong Kim, Gyeonggi-do (KR); Sa Sung Youm, North Rocks (AU); Richard Michael, Parramatta (AU)

( * ) Notice: Subject to any disclaimer, the term of this patent is extended or adjusted under 35 U.S.C. 154(b) by 63 days.

(21) Appl. No.: 16/292,640

(22) PCT Filed: Aug. 23, 2017

(86) PCT No.: PCT/AU2017/000175
§ 371 (c)(1),
(2) Date: Mar. 5, 2019

(87) PCT Pub. No.: WO2018/045408
PCT Pub. Date: Mar. 15, 2018

(65) Prior Publication Data

US 2019/0322444 A1 Oct. 24, 2019

(30) Foreign Application Priority Data

Sep. 8, 2016 (AU) ..... 2016903616

(51) Int. Cl.
*B65D 85/20* (2006.01)
*B65D 61/00* (2006.01)

(52) U.S. Cl.
CPC ..... *B65D 85/20* (2013.01); *B65D 61/00* (2013.01)

(58) Field of Classification Search
CPC ..... B65D 85/20; B65D 61/00
USPC ..... 206/443, 597, 53, 451, 452
See application file for complete search history.

(56) References Cited

U.S. PATENT DOCUMENTS 441,607 A * 11/1890 Woodward ..... B65D 63/10 24/17 R
1,082,848 A * 12/1913 Dargin ..... B65D 63/1018 24/17 A
2,730,259 A * 1/1956 Frick ..... B65D 71/0092 217/43 R
4,378,923 A * 4/1983 Takei ..... B65D 61/00 108/51.3
5,058,746 A * 10/1991 Morgan, IV ..... B65D 19/18 206/597
5,123,547 A * 6/1992 Koch ..... F16L 3/2235 211/59.4
5,803,257 A * 9/1998 Bartholomew .... B65D 71/0092 206/451
6,032,801 A * 3/2000 Jupille ..... B65D 1/38 108/55.3
7,080,864 B2 * 7/2006 Casteran ..... B65D 85/20 211/60.1
2018/0162614 A1 * 6/2018 Lu ..... B65D 85/20

* cited by examiner

*Primary Examiner* — J. Gregory Pickett
*Assistant Examiner* — Jenine Pagan
(74) *Attorney, Agent, or Firm* — Justin Lampel

(57) ABSTRACT

The present invention relates to packaging systems (assemblies) and more particularly, but not exclusively to packaging systems (assemblies) to secure elongated products, such as extruded products, in a bundle for transportation.

9 Claims, 23 Drawing Sheets

PACKAGING ASSEMBLY

FIELD

The present invention relates to packaging systems (assemblies) and more particularly, but not exclusively to packaging systems (assemblies) to secure elongated products, such as extruded products, in a bundle for transportation.

BACKGROUND

Elongate products, such as aluminium or plastic extrusions, are typically long products that are fragile and/or easily damaged. Such products are transported in bundles or groups that can be difficult to handle, due to the size, weight, shape and fragility of the bundles. Thus the transportation and storage of such elongate and extruded products presents unique difficulties.

Typically, these products will be stacked for transportation, with timber skids, cleats or pallets used to vertically separate groups of the products. Timber is cheap and commonly used for such purposes, but has the disadvantage that it is liable to move or become loose in transit, resulting in damage to the products. Furthermore, timber has the disadvantage that it is a single use disposable material and can become affected by environmental factors, such as moisture or pests, which will have consequences on the strength and reliability of the packaging, particularly when re-used.

Packing straps are used to tie stacked products, which may or may not be stacked on pallets, however the straps have the disadvantage that product, even when strapped, can still shunt relative to each other in transit. Furthermore, the straps can damage the surface of the products and leave nothing to support the products after the straps have been removed and before removal of the products from the transportation surface—such a surface being, for example, the flat bed of a truck, a train carriage or shipping container.

Timber skids and cleats are not often reused due in part to their inconsistent sizing, and the consequent difficulty in locating appropriately sized timber skids and cleats for a particular application, but also due to the costs associated with recycling and freighting empty skids and cleats.

An alternative reusable system for transporting elongate or extruded products has been proposed, which involves placement of products in a three-sided metal skip. However, the metal skips have disadvantages, that is they are heavy, expensive and occupy a lot of space even when empty, thus making them difficult to be cost-effectively returned to a product supplier. Such metal skips are also of fixed dimensions and are thus only suitable for use with products or groups of products of a limited range of dimensions.

Described in Australian Patent 2011100549 is a packaging system particularly adapted for the transportation of elongated products such as aluminium and plastic extrusions. The system addresses some of the above issues The above packaging system includes a rectangular frame providing an aperture within which the elongated products are located so that the frame surrounds the products. The frame includes an upper cleat and a lower cleat that are spaced but are essentially parallel and coextensive. Extending between the cleats are side supports, that are upwardly extending and are also generally parallel and co-extensive. Each side support engages the upper and lower cleat so as to provide the generally rectangular frame. The side supports also provide for stacking of the frames. A disadvantage of the packing system described in the above Australian patent application is that the upper cleat, under the influence of gravity, falls on top of the stacked articles below. Additionally, stacking of the packing system and items contained therein, is by way of the side supports projecting upwardly. The distance of the side supports project upwardly above the upper cleat depends on the volume of material stacked inside the packing system. Accordingly, stacking can be a difficulty.

Described in USA Patent 7080864 is a frame assembly that supports a plurality of pipes to be lifted by a crane. The frame assembly includes a pair of upright plates between which there extends a plurality of generally parallel by spaced spacers. The spacers have recesses within which the pipes are located with the pipes located between adjacent spaces. A disadvantage of this assembly is that it does not accommodate variations in the size of the bundles to be transported.

Object

It is the object of the present invention to overcome or substantially ameliorate at least one of the above disadvantages.

SUMMARY OF INVENTION

There is disclosed herein a packaging assembly including:

an upper cleat;

a lower cleat;

a first and a second side support, each side support extending between the upper and lower cleats and being attached thereto so that the upper cleat and lower cleat are spaced by a distance, with the cleats and side supports provide a generally rectangular frame surrounding a aperture within which product to be transported is to be located; and wherein the first side support and the second side support are elongated so as to have a longitudinal length extending between the upper cleat and the lower cleat, with each longitudinal length being adjustable so that said distance is adjustable.

Preferably, each support has a plurality of ratchet teeth and a resilient pawl urged into engagement with the ratchet teeth of the respective support to aid in retaining each support secured to the cleats so that the distance is maintained.

Preferably, the resilient pawl, upon sufficient force being applied thereto, can move along the ratchet teeth to provide for movement between the upper and lower cleats, and therefore adjustment of said distance.

Preferably, each support includes a base and a part associated with the base to provide for relative sliding movement therebetween, to provide for the adjustment of and distance.

Preferably, the support part of each side support has the ratchet teeth, and the associated support base the resilient pawl.

Preferably, the assembly includes a strap that passes about the upper cleat, lower cleat and first and second side supports, with the strap tensioned being engaged with the pawls to retain the side supports fixed at the longitudinal length thereof.

There is still further disclosed herein a packaging assembly including:

an upper cleat;

a lower cleat;

a first and a second side support, each side support extending between the upper and lower cleats and being attached thereto so that the upper cleat and lower cleat are spaced by a distance, with the cleats and side supports providing a generally rectangular frame surrounding an aperture within products to be transported is to be located; and wherein the upper cleat and the lower cleat each have opposite end extremities, and each side supports having an upper end extremity and a lower end extremity, with the end extremities providing projections and sockets so that each projection is received within a respective socket to secure the side supports to the cleats.

Preferably, each cleat end extremity is provided with at least one of the sockets, and each side supports end extremity is provided with one of the projections that are received within a respective one of the sockets.

Preferably, the upper cleat and the lower cleat each have opposite end extremities, and each side supports has an upper end extremity and a lower end extremity, with the end extremities providing projections and sockets so that each projection is received within a respective socket to secure the side supports to the cleats.

Preferably, each cleat end extremity is provided with at least one of the sockets, and each side supports end extremity is provided with one of the projections that are received within a respective one of the sockets.

Preferably, at least one of the projections includes a resilient pawl that releasably fixes at least one of side supports to an associated one of the cleats.

In one preferred form, each resilient pawl engages the upper cleat.

In an alternative preferred form, each resilient pawl engages the lower cleat.

BRIEF DESCRIPTION OF DRAWINGS

Preferred forms of the present invention will now be described by way of example with reference to the accompanying drawings wherein.

DESCRIPTION OF EMBODIMENTS

A packaging system (assembly) 10, for the transportation of an elongate product 12, is illustrated in FIGS. 1 to 12 of the accompanying drawings. The packaging system 10 finds use in transporting elongate product such as plastic, metal or composite extrusions, timber or any manufactured products having length and requiring transportation, and bundles or groups thereof.

Figure 1:
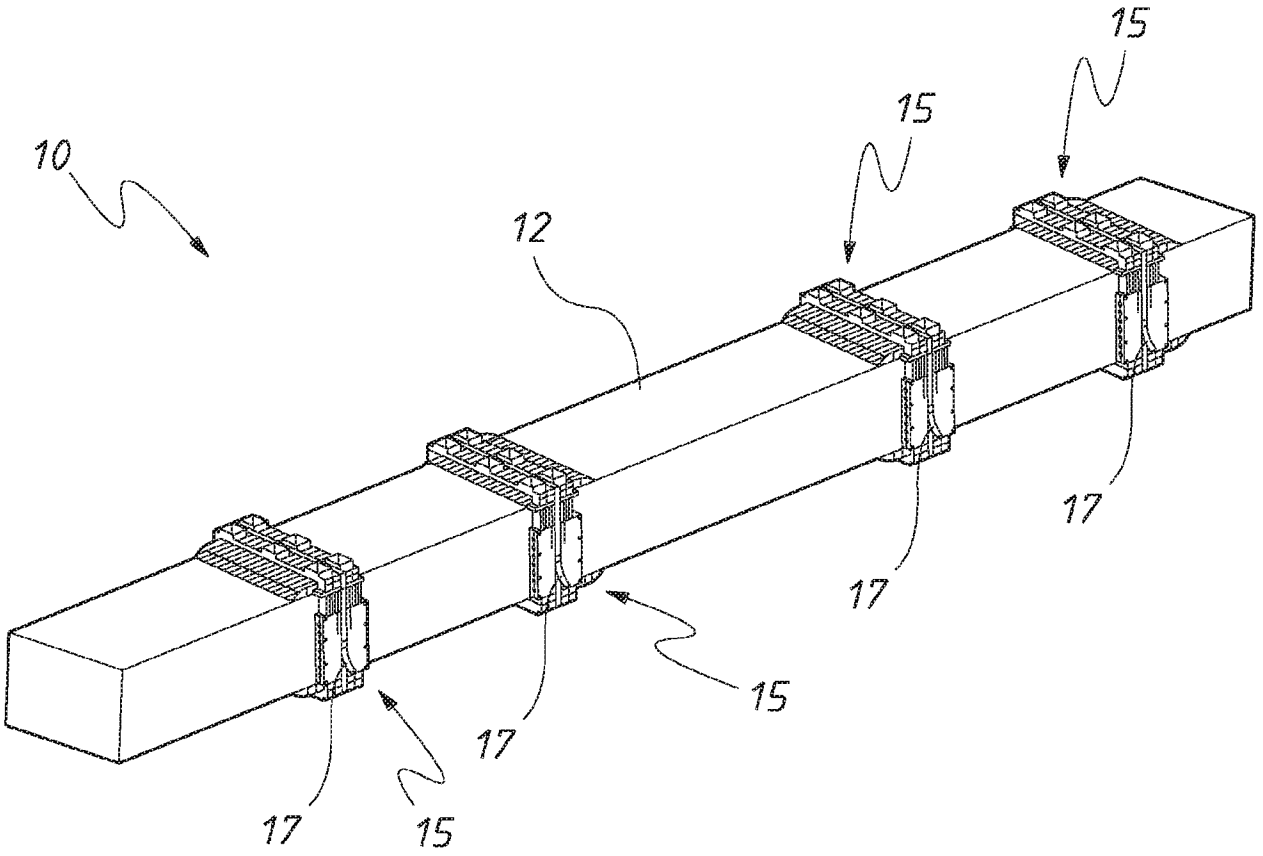
FIG. 1 is a top perspective view of a packaging system (assemblies) in use.

FIG. 1 shows the packaging system in use with four cleat units 15 evenly distributed along the length of the product 12 to evenly bear the load of the product. The cleat units 15 can be spaced as appropriate to, for example, accommodate a particular elongate product 12 or to account for different types of cleat material. For example: heavier elongate products 12 may require a greater number of cleat units 15 to be used in order to adequately support its weight; a product 12 with non-uniform weight distribution may require non-uniform cleat unit 15 distribution along its length; and cleat units 15 made from lighter materials may warrant the use of more cleat units 15 in order to properly support the elongate product 12, without damage to either the elongate product 12 or cleat units 15. The spacing between cleats will therefore vary depending on the nature, including weight, of the product to be loaded and according to specific end user requirements. However, by way of example only, the spacing between cleat units carrying timber, centre to centre, could be between 1.0 m and 1.5 m, such as 1.2 m.

Product 12 extends through a space 14 in the cleat units 15 formed by a lower cleat 16, an upper cleat 18 and side cleats 20 that interconnect the lower and upper cleats. Straps 17 extending at least part way around the assembly of the cleat unit assist in tightly securing the cleat unit around the product 12. The side cleats 20 are height adjustable, and able to be set at variable heights, to vary the spacing between the upper and lower cleats and thereby adjust to the correct height correlating to the product 12 being supported.

The advantage of this system is that it is easy to use, it reliably provides a very stable package for transportation and it can be re-used to suit a variety of different applications and products. The cleat units 15 can form a substantially rigid structure so that there is little or no relative movement of the lower and upper cleats 16, 18 during transportation. Thus shunting of cleat units 15 against each other can be avoided.

Figure 2A:
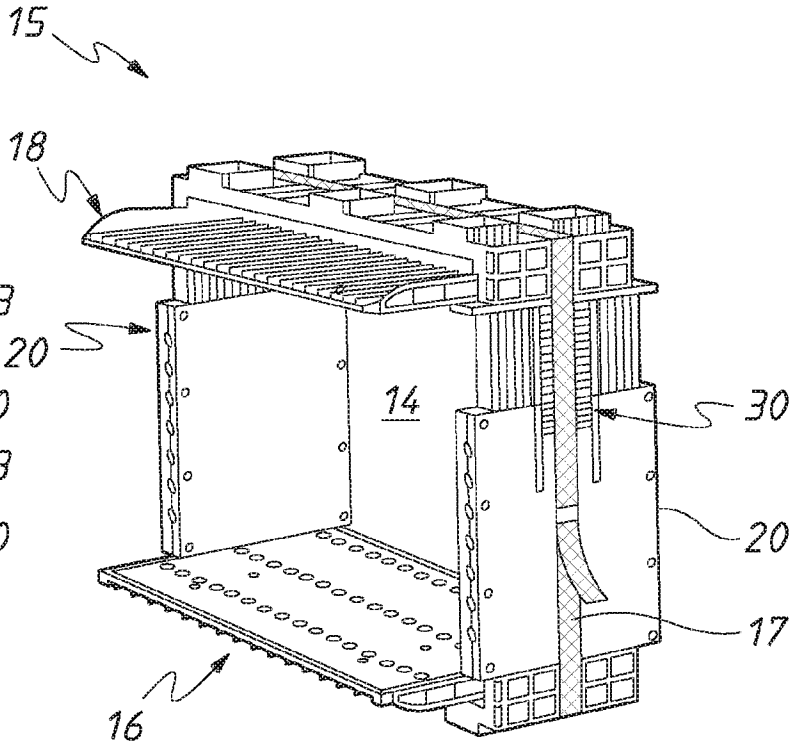
FIG. 2A is a perspective view similar to FIG. 2 but showing strapping applied around the cleat unit.
Figure 2:
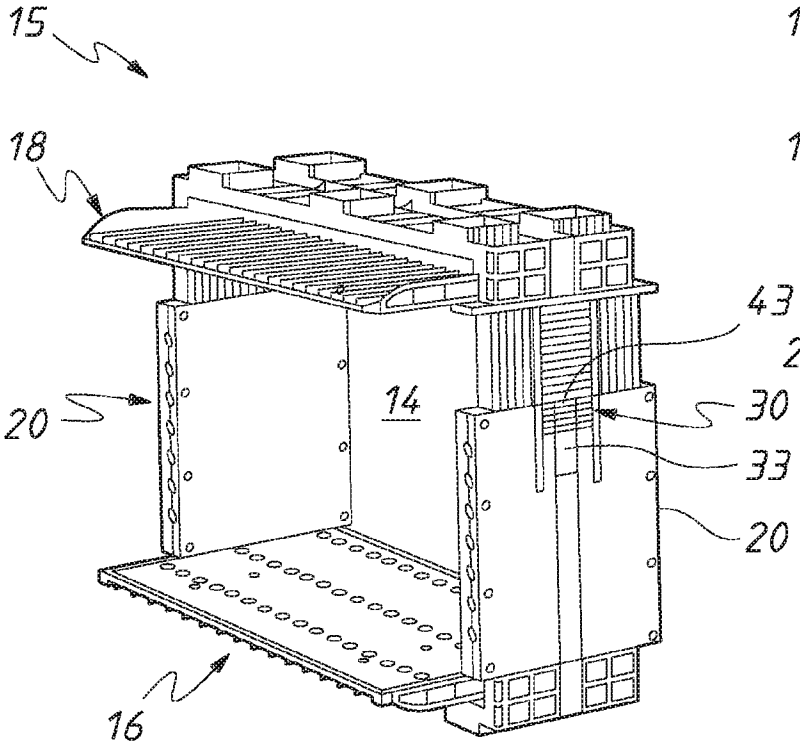
FIG. 2 is a perspective view of a cleat unit of the packaging system of FIG. 1 in a mostly retracted condition.
Figure 3:
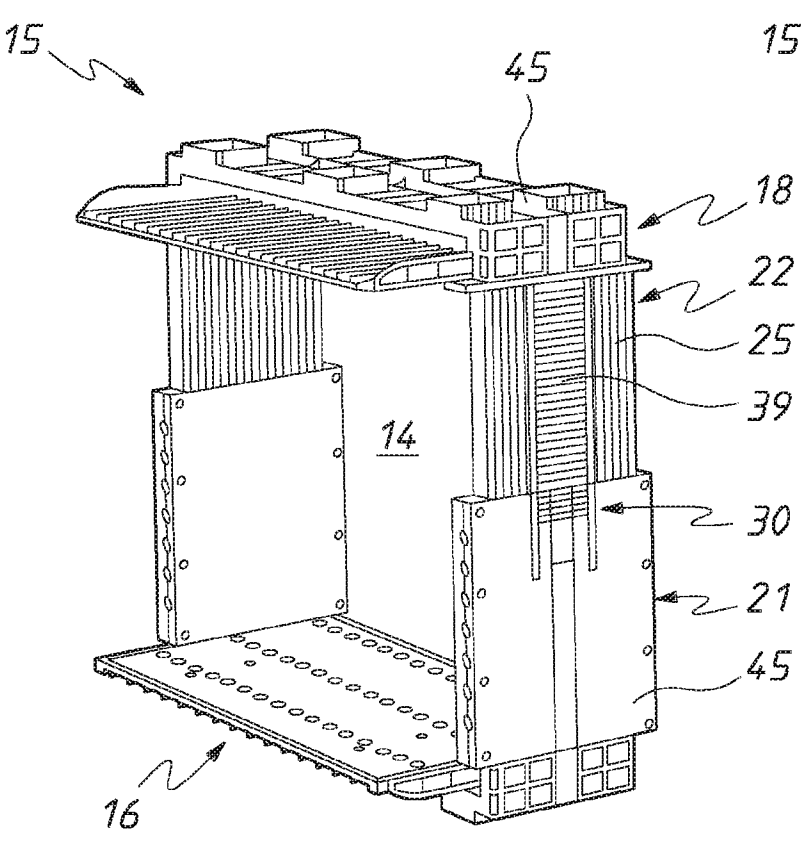
FIG. 3 is the perspective view of the cleat unit shown in FIG. 2 in an extended condition.
Figure 5:
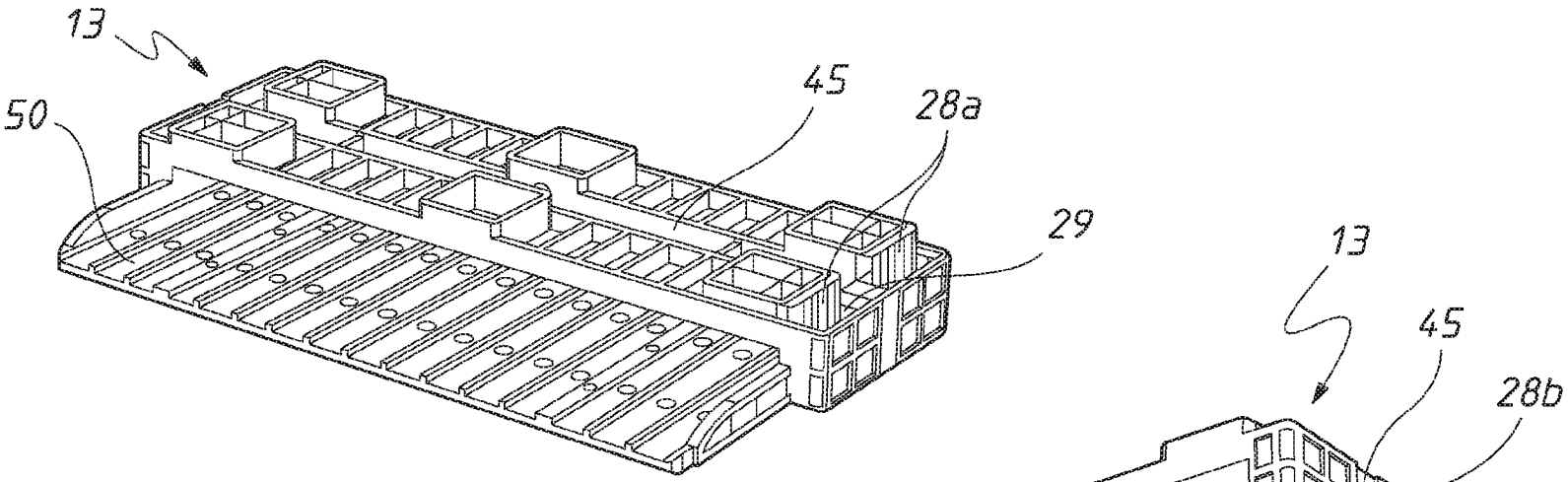
FIG. 5 is an upper perspective view of the lower/upper cleat.
Figure 6:
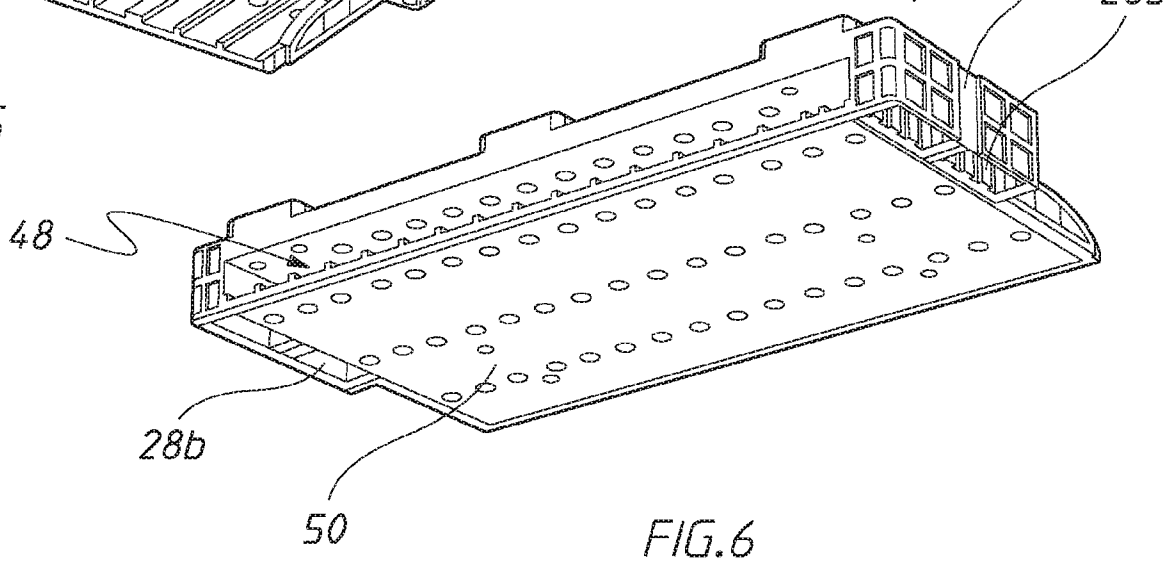
FIG. 6 is a lower perspective view of the lower/upper cleat.

The side cleats (side supports) 20 are substantially planar supports interconnected between the upper and lower cleats that telescopically slide relative to each other to extend and retract between a shortened, retracted position to an extended full height position by way of at least two sliding parts that substantially overlap in the retracted position but extend to elongate with less overlap in the extended position. In the preferred embodiment illustrated in the drawings there is a first, lower sliding part 21 having a receiving recess 24 to receive a second, upper sliding part 22. FIG. 2 illustrates the cleat unit 15 in an almost retracted position with upper part 22 nested within recess 24 of lower part 21. FIG. 3 illustrates the upper part 22 extended upwardly from lower part 21 to thereby raise the height of side cleat 20 and increase the area of space 14 through which a product extends and is supported. Accordingly, products of various heights may be supported by the same cleat units 15.

Figure 4:
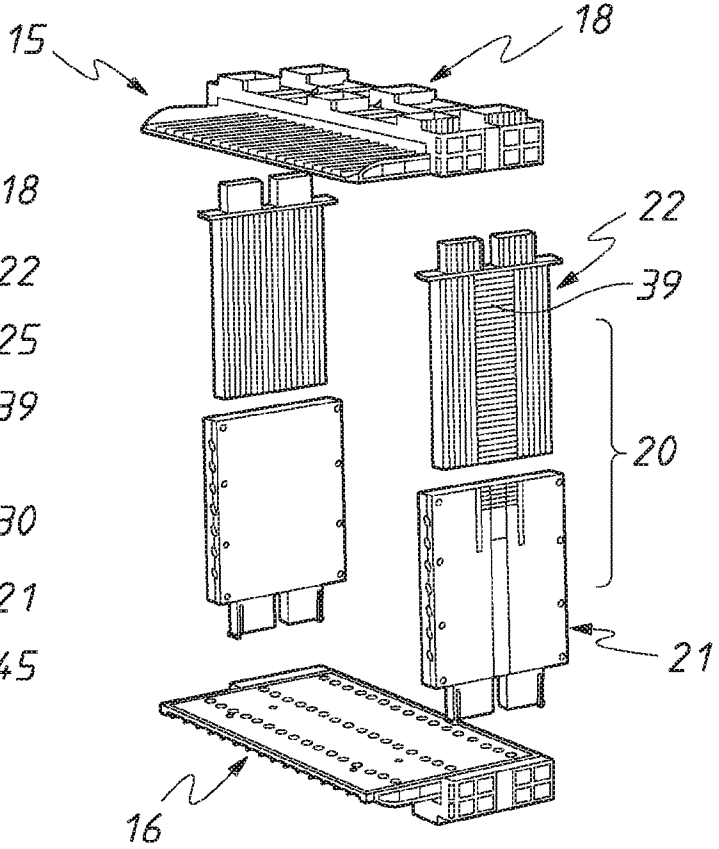
FIG. 4 is an exploded perspective view of the cleat unit.
Figure 9:
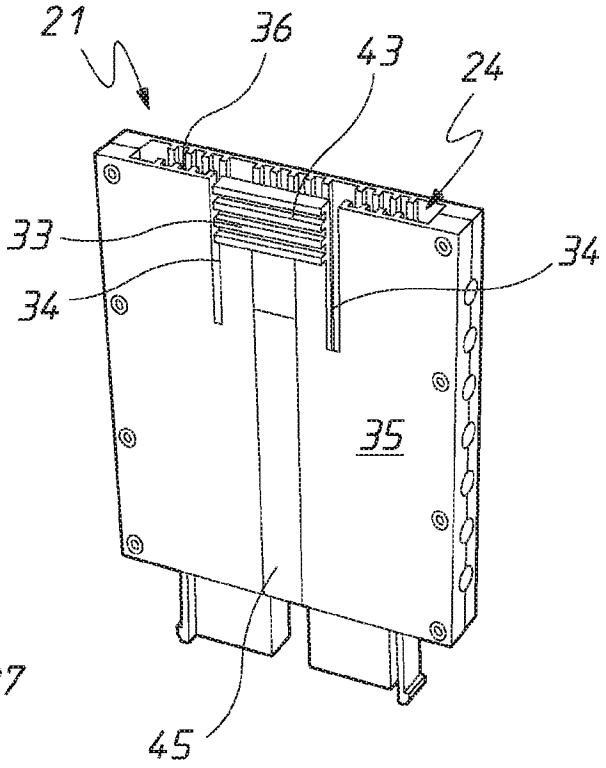
FIG. 9 is an outer perspective view of the first part of the side cleat.
Figure 8:
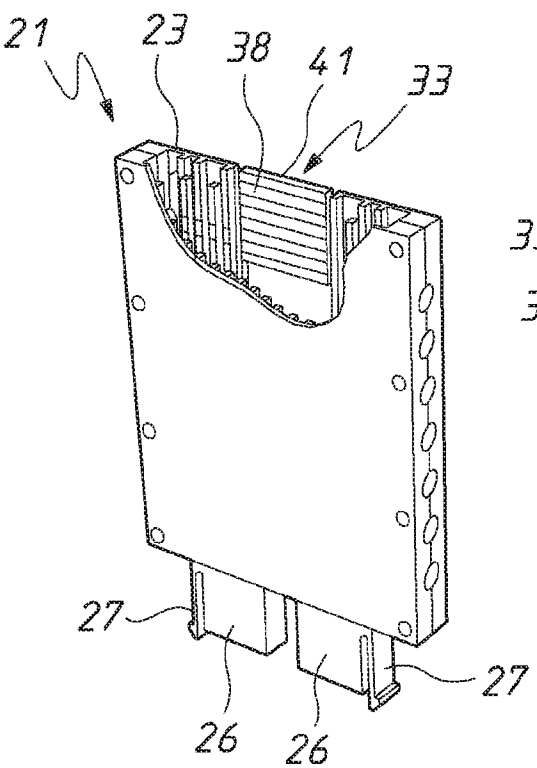
FIG. 8 is a view similar to FIG. 7 but with an inner wall partly removed to show inside the first part.
Figure 7:
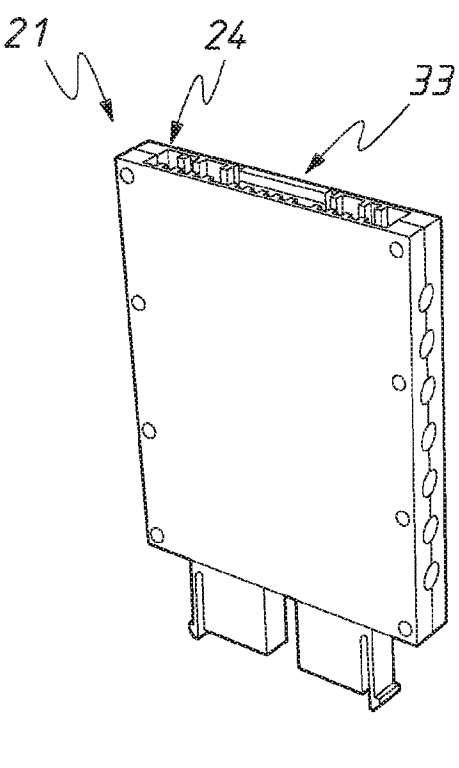
FIG. 7 is an inner perspective view of a first part of the side cleat.
Figure 11:
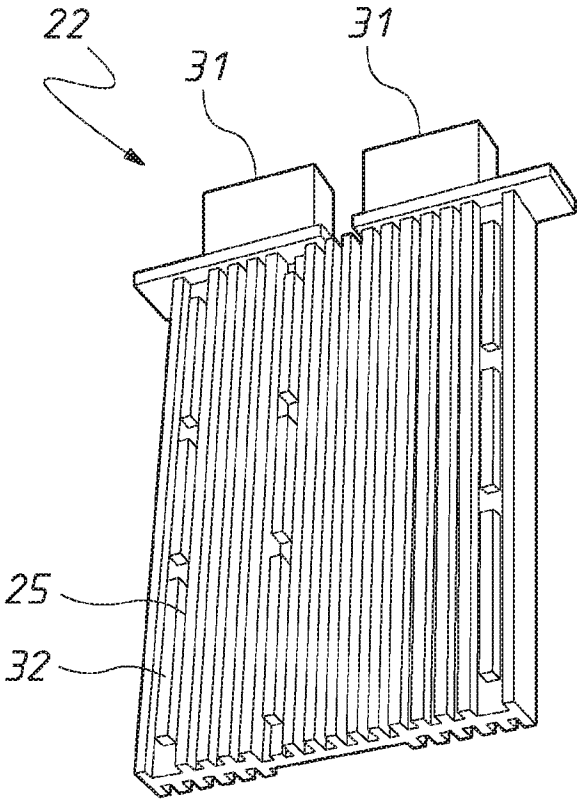
FIG. 11 is an inner perspective view of the second part of the side cleat.
Figure 10:
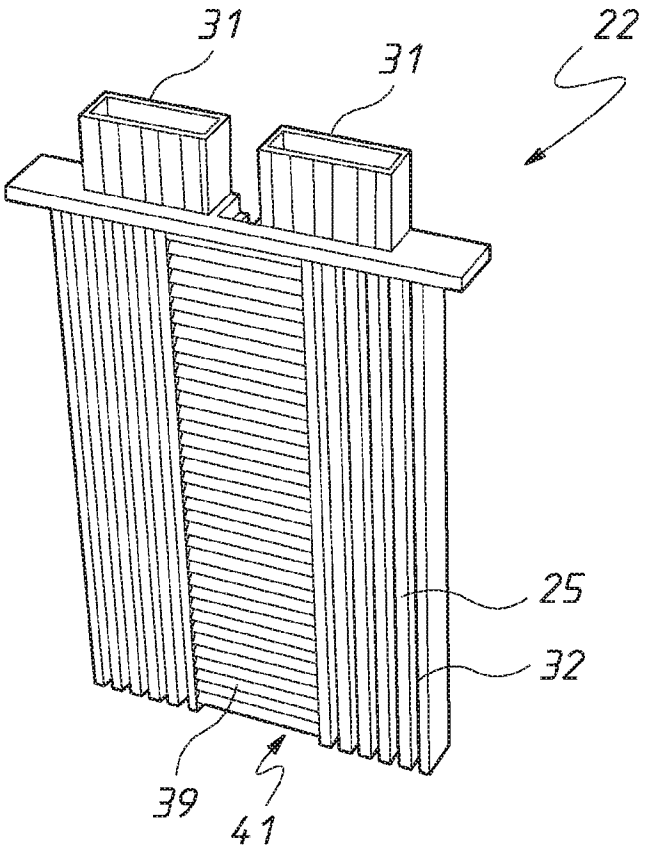
FIG. 10 is an outer perspective view of the second part of the side cleat.

For clarity, FIG. 4 illustrates the components of a cleat unit 15 in exploded view. FIGS. 7, 8 and 9 illustrate the lower sliding part 21 and FIGS. 10 and 11 illustrate the upper sliding part 22. Longitudinal guide spines 23 in receiving recess 24 engage with longitudinal guide grooves 25 on upper part 22 to maintain a sliding motion between the two parts. Guide grooves 25 are formed by further spines 32 that alternate with the lower part's guide spines 23.

The lower part 21 includes two connectors 26 with detents (resilient pawls) 27 provided at a lower end thereof for interconnecting the side cleat to the lower cleat 16. Lower cleat 16 has upwardly facing connection pockets 28*a* that correspond in shape and size to receive the connectors 26. The resilience of detents 27 against stops 29 in the pockets 28*a* create a snap-lock connection between lower sliding part 21 and lower cleat 16.

Upper sliding part 22 includes two locators 31 upstanding from an upper end of upper part 22 for locating into a downwardly facing corresponding connection pocket 28*b*. Pockets 28*a* and 28*b* are the same pocket structure where 28*a* is open upwardly to receive a connection (from the lower part 21) and 28*b* is open downwardly to receive another connection (from the upper part 22). The pockets 28*a* and 28*b* may be open through to each other, with a stop or constriction in the middle to prevent one interconnected component from extending right through the pocket, or the pockets may be closed, being blind pockets.

The side cleats are height adjustable and are set to the selected height by the application of a force on one or both side cleats, where that force is directed inwardly of the cleat unit. The force acts on a locking mechanism 30 that obstructs the adjustability function of the side cleat 20. The locking mechanism includes a resilient member, in the form of a tongue (resilient pawl) 33, on the lower sliding part 21 being urged against the upper sliding part 22 and to engage therewith to obstruct the sliding motion between the parts.

Tongue 33 is integrally formed with the housing structure of lower part 21 at an upper central portion thereof and is defined by two lateral slits 34 cut down into an outer face 35 of the lower part 21 from an upper edge 36 defining the opening to the receiving recess 24. The tongue obtains its resilience by way of the shape of the slits 34 and/or the properties of the material used for the side cleats, which may be a mouldable plastic or formed from metal.

The tongue has a first locking component that engages with a second locking component on the portion of the upper sliding part 22 that slides adjacent and close to the tongue. As can be seen in FIG. 8, an inner side of the tongue specifically has ratchet-shaped teeth 38. The teeth are ramped on one side up to an acute angle at the apex of the tooth where a perpendicular surface 41 of each tooth then turns back to meet the tongue at a perpendicular angle. The tongue's teeth 38 are configured to engage with correspondingly ratchet-shaped, but in a reverse direction, teeth 39 provided in rows across a central panel that runs down the length of the upper portion 22 (see FIG. 10). Teeth 39 of the upper part are similarly profiled to the tongue's teeth 38.

While no force is applied to tongue 33 the reverse directional ratchet teeth of the tongue and upper part can slide past each other without interference. This allows for relative extension of the upper and lower sliding parts, and hence adjustment of the height of the side cleat 15. However, when the selected height is reached pressure is applied against the tongue 33 to move it towards the upper cleat 22 and thereby engage the locking mechanism of the corresponding ratchet teeth 38, 39. The perpendicular surfaces 41 of the engaging teeth abut flatly against each other to prevent any sliding movement between the parts. If the tongue is not pressed, or only partly pressed, the ramped surfaces of the teeth on the respective upper and lower parts will allow sliding movement between the parts to take place event if they are slightly touching. However a firmer inward force against the tongue will engage the teeth and prevent movement. Disengagement of the locking mechanism occurs when the pressure on the tongue 33 is removed and the tongue, being resilient, moves back to a neutral position away from contact with the upper part 22.

Force on the tongue 33 may be applied by various means but the force needs to be one that can be held, indefinitely. Such force could be applied by using fasteners such as locking clips or clasps, but in the embodiment described herein the force is applied by the strapping that extends at least partly around the upper, lower and side cleats and that is used to secure the cleat unit tightly around the product. As shown in FIG. 2A the strapping 17 is adapted to extend over tongue 33 so that when the strapping is tightened the tightening force on the strap will in turn press inwardly against the tongue forcing the tongue's teeth 38 against, and into contact with, the teeth 39 of the upper part and thereby fix, or lock, the spacing between the upper and lower cleats by preventing any movement within the side cleat.

The strapping 17 used can be any kind of reliable strapping used to secure cargo including metal or plastic straps, or straps made from woven or knitted fibres. As discussed above, the inward force onto tongue 33 need not be exclusively applied by using straps, but could be applied by other force applying mechanism, such as stretch film wrap applied using spiral wrapping equipment. The tension of the wrapped film in the instance would apply a holding/locking force on the tongue that will lock the extension of the side cleat and stop sliding. Still another alternative could be to provide the cleat unit with a sliding or hinged latch that can be moved to lock movement of the side cleat extension by acting as a detent.

As can be seen in FIG. 9, the outer facing side of the tongue 33 includes a series of outwardly raised ribs 43. These ribs protruding outwardly are to encourage purchase of the straps on the tongue and increase the force on the tongue to move it inward into locking engagement with the upper part.

Accurate positioning of the packaging strap 17 is maintained through strapping guides 45 in the form of strap channels provided in both the upper cleat 18 and the side cleats 20. The strap channels 45 can be in the form of lateral ridges or a sunken recess provided on a wall of the cleat part (as provided on the side cleat 20) or in the form of a continuous channel between structural components of the cleat (as provided on the upper surface of the upper cleat 18.

Turning back to FIGS. 5 and 6, illustrated in those figures is a generally rectangular and planar cleat component 13 that is both the upper cleat 18 and the lower cleat 16. Cleat component 13 is formed such that in one orientation it acts as a lower cleat and in an opposite, upside down orientation, it acts as an upper cleat. Cleat component 13 includes a substantially flat surface on one planar side, and a rib-strengthened surface with a strap channel 45 on the opposite planar side. Four pockets 28*a* and 28*b* are provided near the shorter edges of the rectangular cleat structure, and as discussed earlier, on one side the pockets 28*a* receive a lower end of the side cleats 15 and on the other side the pockets 28*b* receive an upper end of the side cleats 15.

Accordingly, when the flat surface is assembled facing up, the cleat component 13 will be the lower cleat 16 supporting the load of the product 12, and when the flat surface is assembled facing downwardly, the cleat component will be the upper cleat 18 restraining the product from above.

The cleat component 13 has a cantilevered reinforcing planar extension 50 that extends out one si de of the component. The reinforcing extension increases the effective length of the cleat unit and provides greater protection to the product. The reinforcing extension 50 may be formed integrally with the cleat component 13 as shown in the drawings, for example by moulding, or it may be a separate part that is attached or inserted after manufacture. Also shown (see FIG. 6) is the cleat component having a side entry 48 adapted to receive an additional reinforcement extension (not shown) as a separate component that extends from an opposite side of the cleat component to integral extension 50.

The cleat units 15 may be made of a suitable material that will be sufficiently durable to withstand repeated use and, preferably, lightweight to not add to the weight of the packaging. Suitably, the cleat units can be made of moulded plastics, where the side cleats may be made of the same or a different material to the upper and lower cleats. For instance, the side cleats could be made of a composite material (plastic/graphite/metal) that would increase the strength of the side cleat for holding greater loads.

Figure 12:
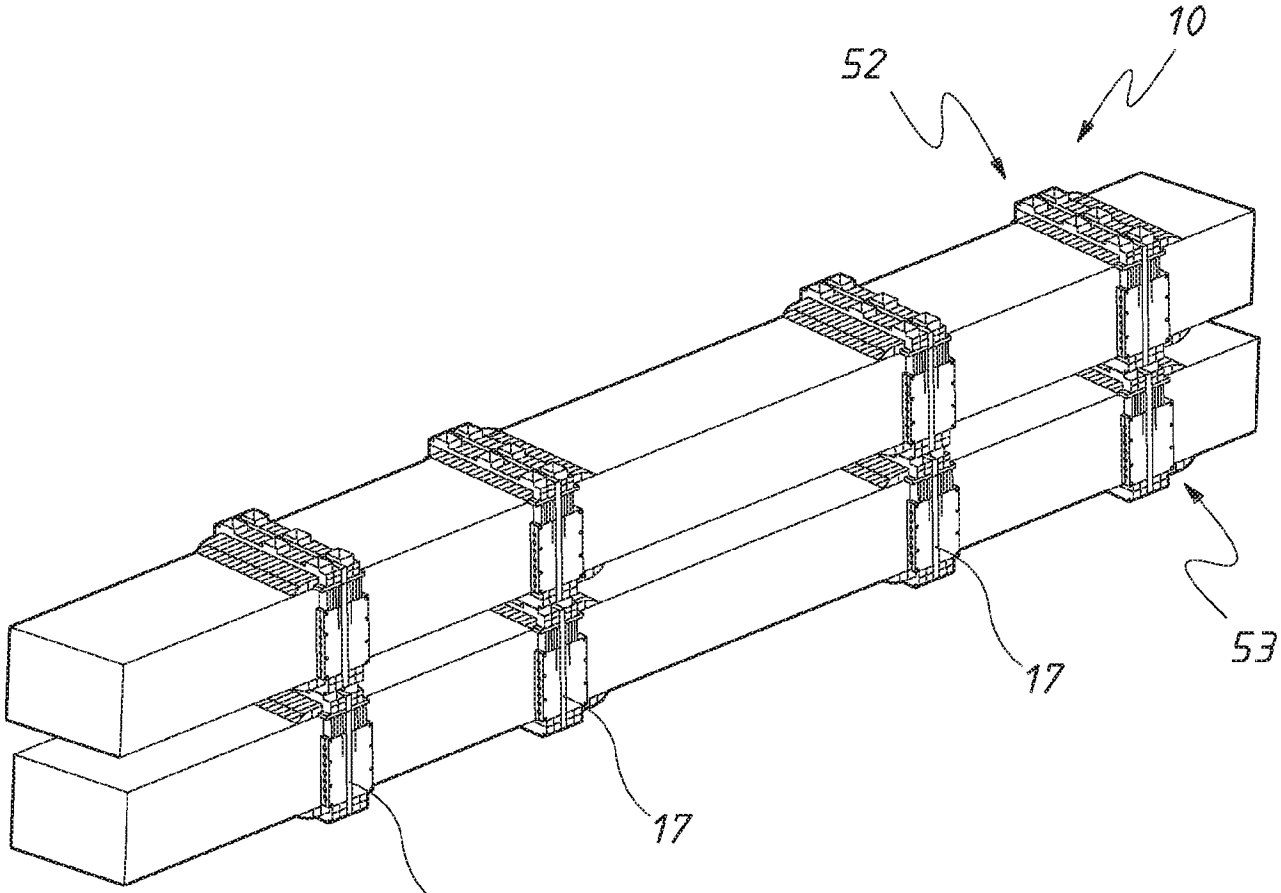
FIG. 12 is a top perspective view of the packaging system with cleat units stacked one on top of the other to provide a double stacked package.

FIG. 12 illustrates the packaging system 10 stacked in a double, one on top, configuration with an top cleat unit 52 and a bottom cleat unit 53. The cleat components are formed to be positively stackable, to make storage and transportation easier and more space saving. In the case of double stacking, strapping 17 can extend around the entire perimeter of the bundled stack with the strapping passing over both tongues of the top and bottom cleat units and when tensioned will apply an inward force on the tongues, inward in the direction of the centre of each cleat unit. The inward force will lock the height of the packaged assemblies and keep them securely in place ready for lifting, transportation and further stacking without shunting and with a reduction in the incidence of damage due to poor or inappropriate packaging.

In FIGS. 13 to 28 of the accompanying drawings there is schematically depicted a packaging assembly 110. The assembly 110 provides a generally rectangular (including square) frame 112 that surrounds an aperture 111. In use of the assembly 110, a plurality of elongated products, such as aluminium or plastic extrusions, extend longitudinally through the aperture 111 so as to be retained as a bundle by the assembly 110.

The frame 112 includes an upper cleat 113 and a lower cleat 114. Preferably the cleats 113 and 114 are longitudinally parallel, transversely spaced and substantially co-extensive.

The frame 112 also includes a pair of side supports 115 that are generally upwardly oriented, generally parallel but transversely spaced, and extend between the cleats 113 and 114. The side supports 115 are also generally co-extensive.

The side supports 115 are longitudinally elongated so as to have a longitudinal length 117, the length 117 is adjustable.

By adjustment of the length 117, the area of the aperture 111 can be adjusted to suit the bundle size of articles to be transported by the assembly 110.

Each end extremity of the cleat 113 is provided with a pair of sockets 120, with each end extremity of the cleat 114 being provided with a pair of sockets 125.

In the embodiment of FIGS. 13 to 17, each side support 115 includes a pair of upper projections 130 and a pair of lower projections 131. Each pair of lower projections 131 is slidably received within a pair of associated sockets 125.

In the embodiment of FIGS. 13 to 17, each pair of upper projections 130 is received within an associated pair of the sockets 120, with at least one of the projections 130 having a resilient pawl 134 that provides for insertion of the projections 130, but resiliently moves to engagement with a surface 135 of the associated socket 120, to retain the support 115 fixed to the upper cleat 113.

In the embodiment of FIGS. 18 to 28, each side support 115 includes a pair of upper projections 130 and a pair of lower projections 131. Each pair of upper projections 130 is received within a pair of associated sockets 120.

In the embodiment of FIGS. 18 to 28, each pair of lower projections 131 is received within an associated pair of the sockets 125, with at least one of projections 131 having a resilient pawl 134 that provides for insertion of the projections 131, but resiliently moves to engagement with a surface 135 of the associated socket 125, to retain the support 115 fixed to the lower cleat 114.

The cleat 114 is provided with a pair of elongated pads 127 that are resilient, and engages the product being transported to at least aid in inhibiting damage to the product, and to aid in inhibiting movement of the product.

Each support 115 includes a base 136 that includes the projections 130, and that co-operates with a cover member 126 to provide a passage 137 that telescopically receives a support part 138. The lower end extremity of the part 138 includes the projections 131. The longitudinal length 117 of each support 115 is provided by sliding longitudinal telescopic movement between the base 136 and the associated part 138. The cover 126, base 136 and part 138 have co-operating ridges and grooves 147 that engage to guide the part 138 in its sliding movement.

The part 138 has a plurality of "ratchet" teeth 139 that extend longitudinally transverse of the longitudinally direction of extension of the part 138, and that are engaged by a resilient pawl 140 of the base 136. The pawl 140 has at least one tooth 141 that engages the teeth 139 to retain the base 136 at a desired position relative to the part 138, that is retaining the base 136 and part 138 so as to provide a desired longitudinal length 117. However, the base 136 and part 138 can be moved relative to each other by a user providing a compressive force or a tensioning force to the base 136 and part 138 to cause elongation or contraction of the support 115. During this relative movement, the tooth 141 moves into and out of engagement with selected teeth 139, by resilient deformation of the pawl 140.

Each support 115 is an assembly including a base 136, cover member 126 and part 138 slidably associated therewith. Each base 136 is fixed to one of the cover members 125 so that the two supports 115 each have the passage 124.

When the assembly 110 is located about a bundle of products, and the length 117 adjusted to the size of the bundle, a strap (such as the strap 17 of FIG. 2A) 145 is placed about the assembly 110 so that the strap 145, upon tensioning pushes, pushes on the projections 148 of the on the pawls 140, to retain the pawls 140 securely engaged with a selected one or more of the teeth 139 so that the length 117 is then fixed. A releasable fastener or catch would retain the strap 145 tensioned. The strap 145, upon being released, would enable elongation of the side supports 115 and removal of the products. The cleats 113 and 114 also urged toward each other, so that the length 117 is adjusted by contractions of the supports 115, so that the bundle is securely held between the cleats 113 and 114. The strap 145 is held in position by being located in slots 146 and 147 of the cleats 113 and 114 and side supports 115.

Preferably, the lower cleat 114 has a lateral projecting flange 142. Where two or more assemblies 110 are employed, the flanges 142 can be located so as to be spaced to suit the tines of a forklift vehicle. Each of the flanges 142 has projecting from its lower surface a plurality of resilient pads 146 that engage a supporting surface.

Preferably, the upper cleat 113 is provided with at least one projection 143. The projection 143 engages within a selected one of the sockets 144 to provide for stacking of the assemblies 110. That is, each assembly 110 has a projection 143 and socket 144 to provide for stacking of the assemblies 110. The projections 143 and sockets 144 inhibit relative movement between stacked assemblies 110.

Figure 13:
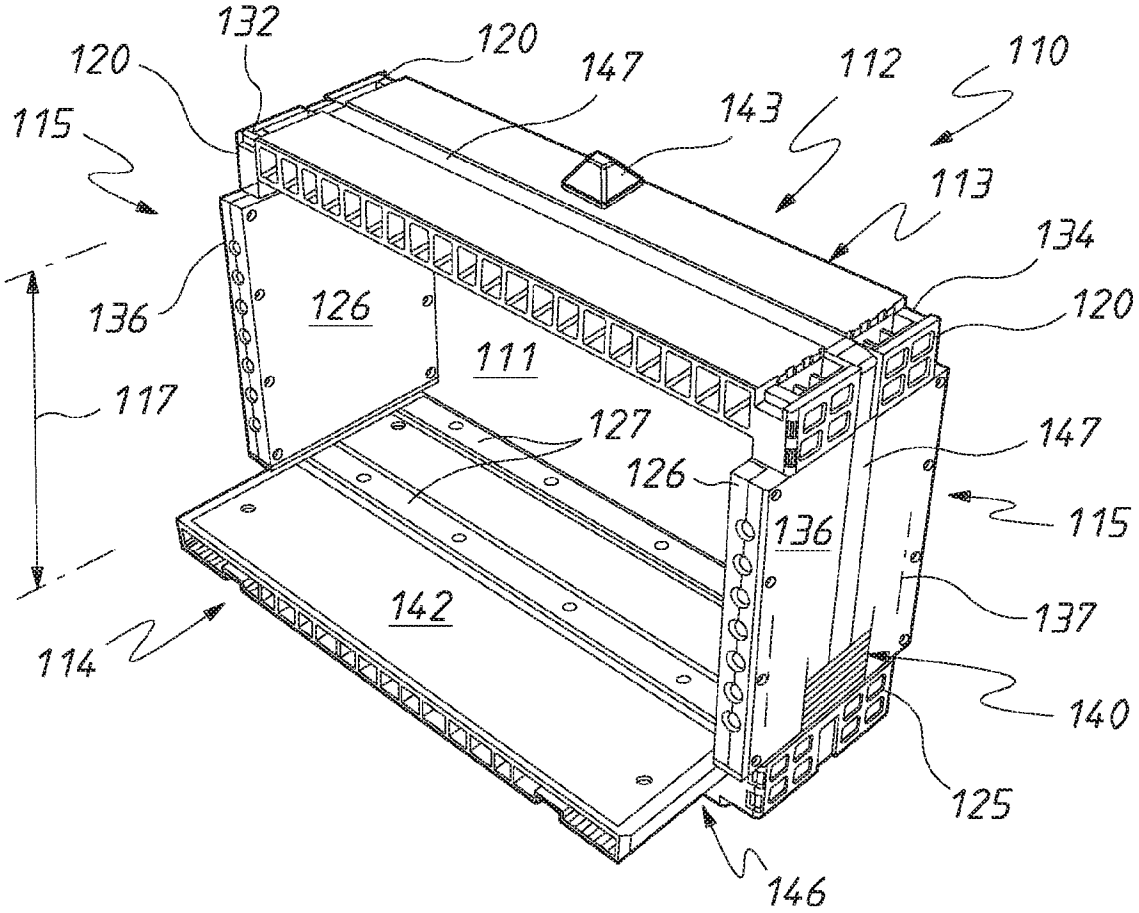
FIG. 13 is a schematic isometric view of another packing assembly.
Figure 14:
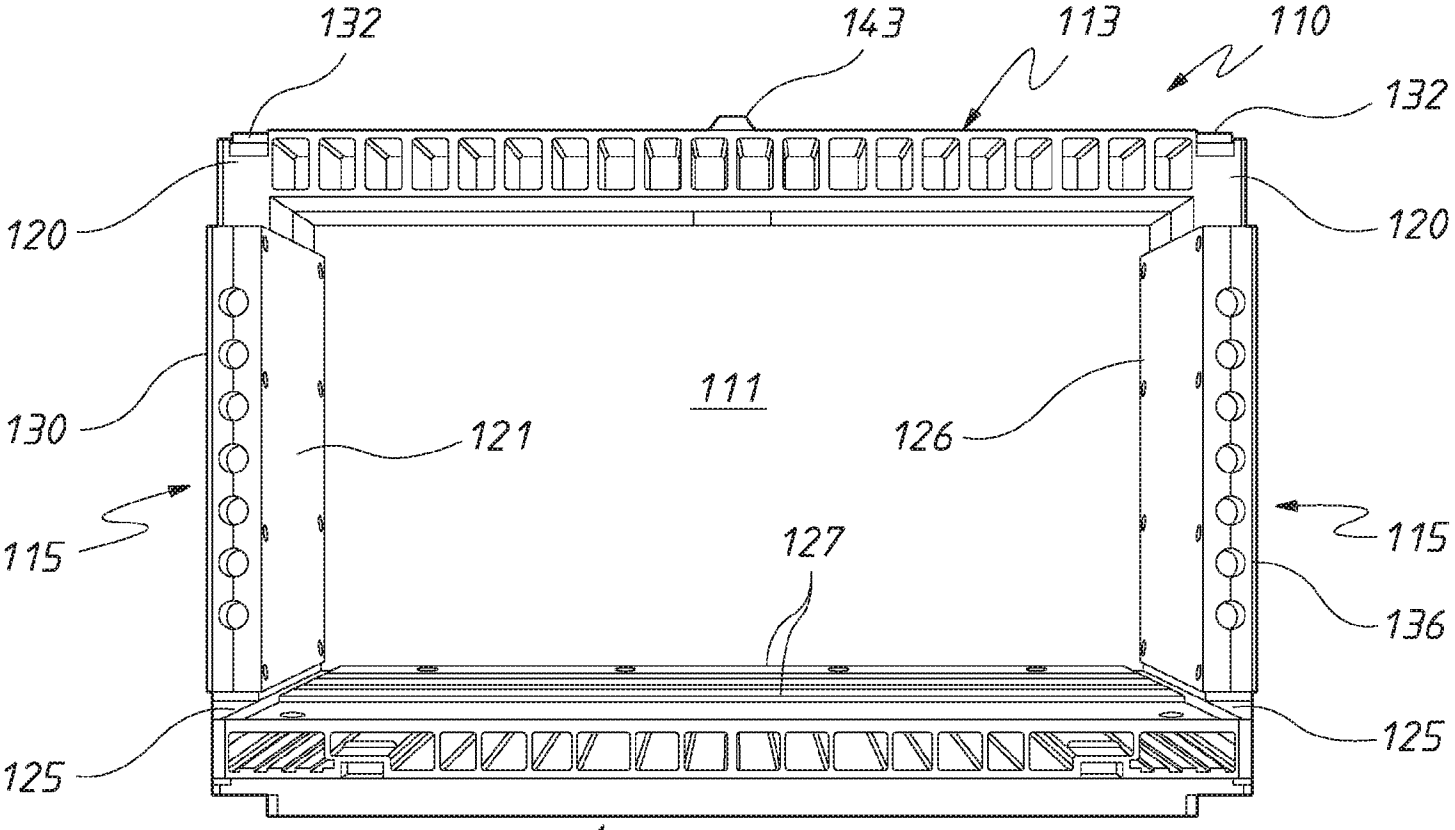
FIG. 14 is a schematic front isometric view of the packaging assembly of FIG. 13.
Figure 15:
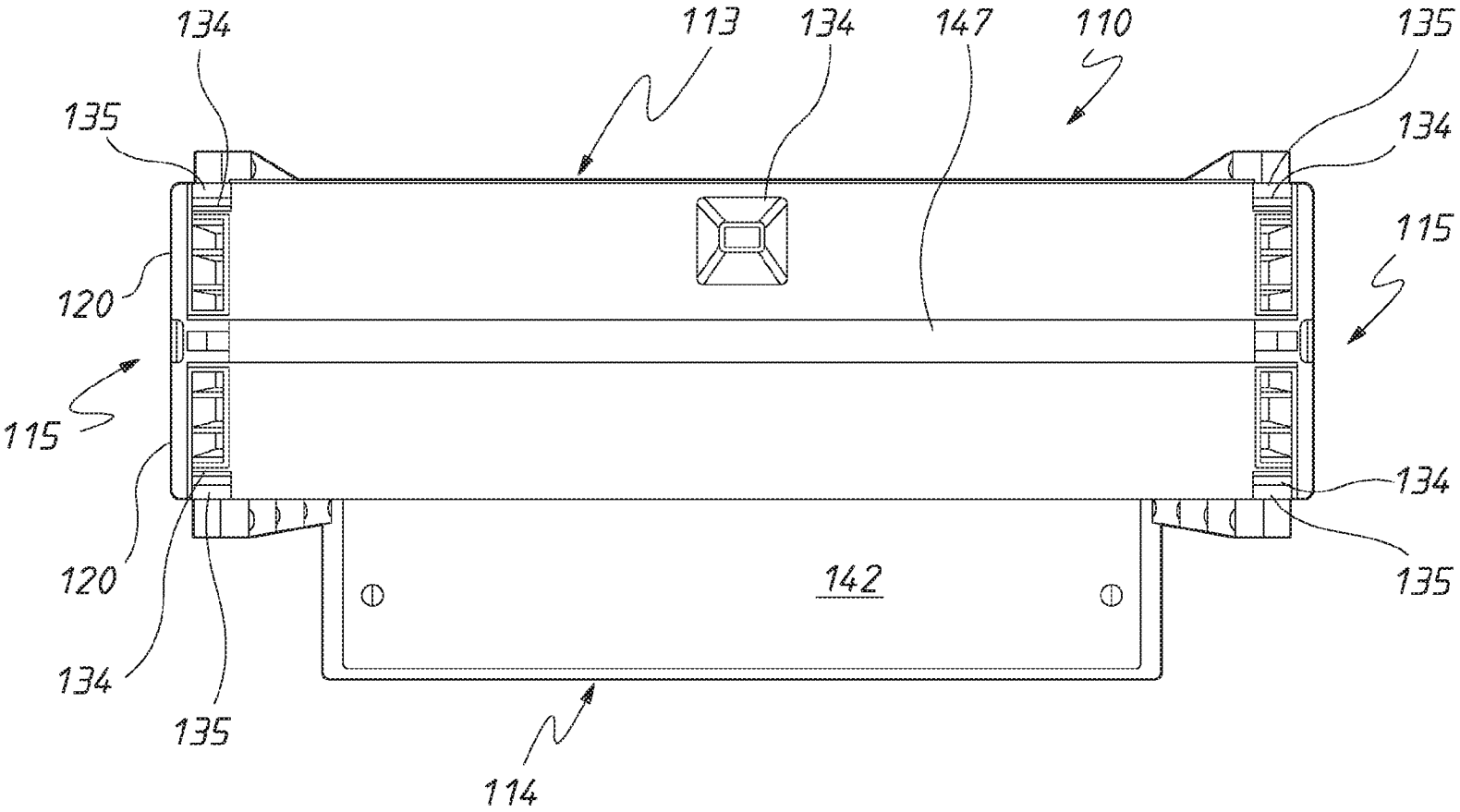
FIG. 15 is a schematic top plan view of the packing assembly of FIG. 13.
Figure 16:
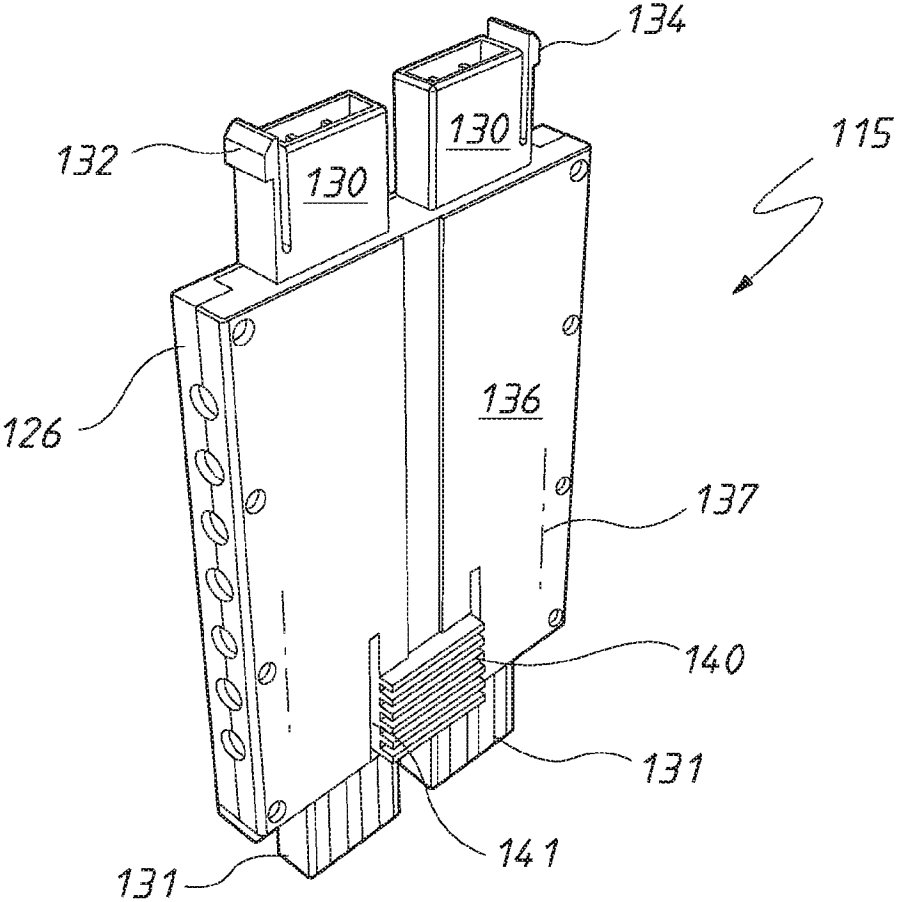
FIG. 16 is a schematic isometric view of a side support of the assembly of FIG. 13.
Figure 17:
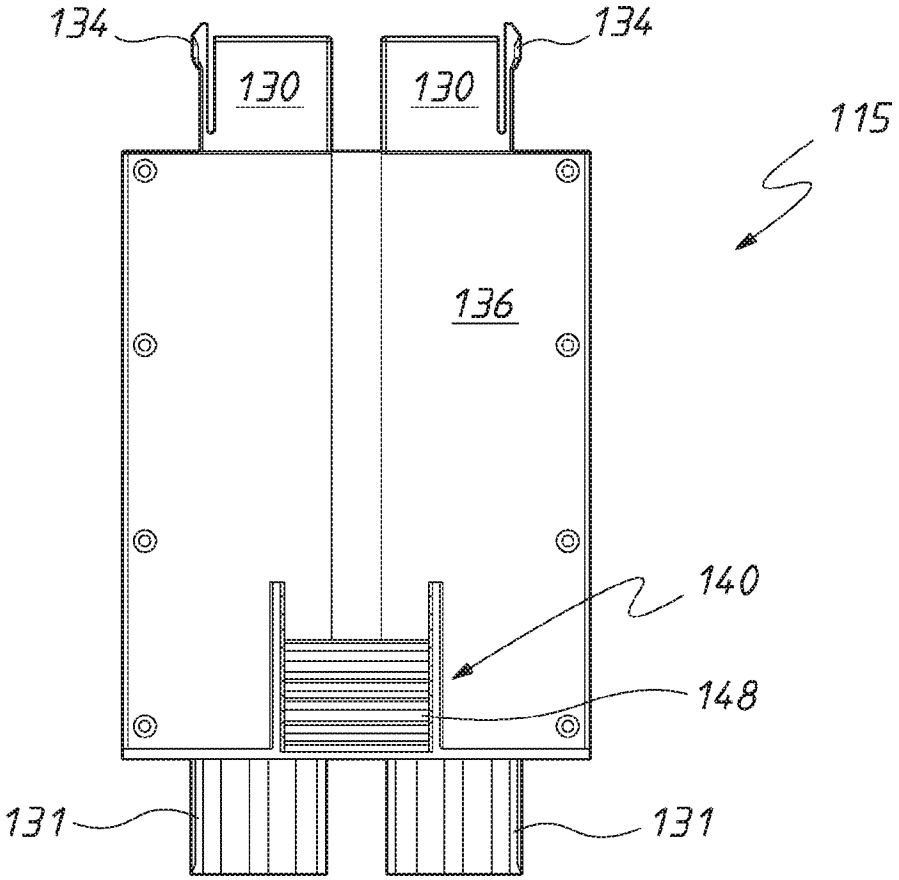
FIG. 17 is a side elevation of the support of FIG. 16.
Figure 18:
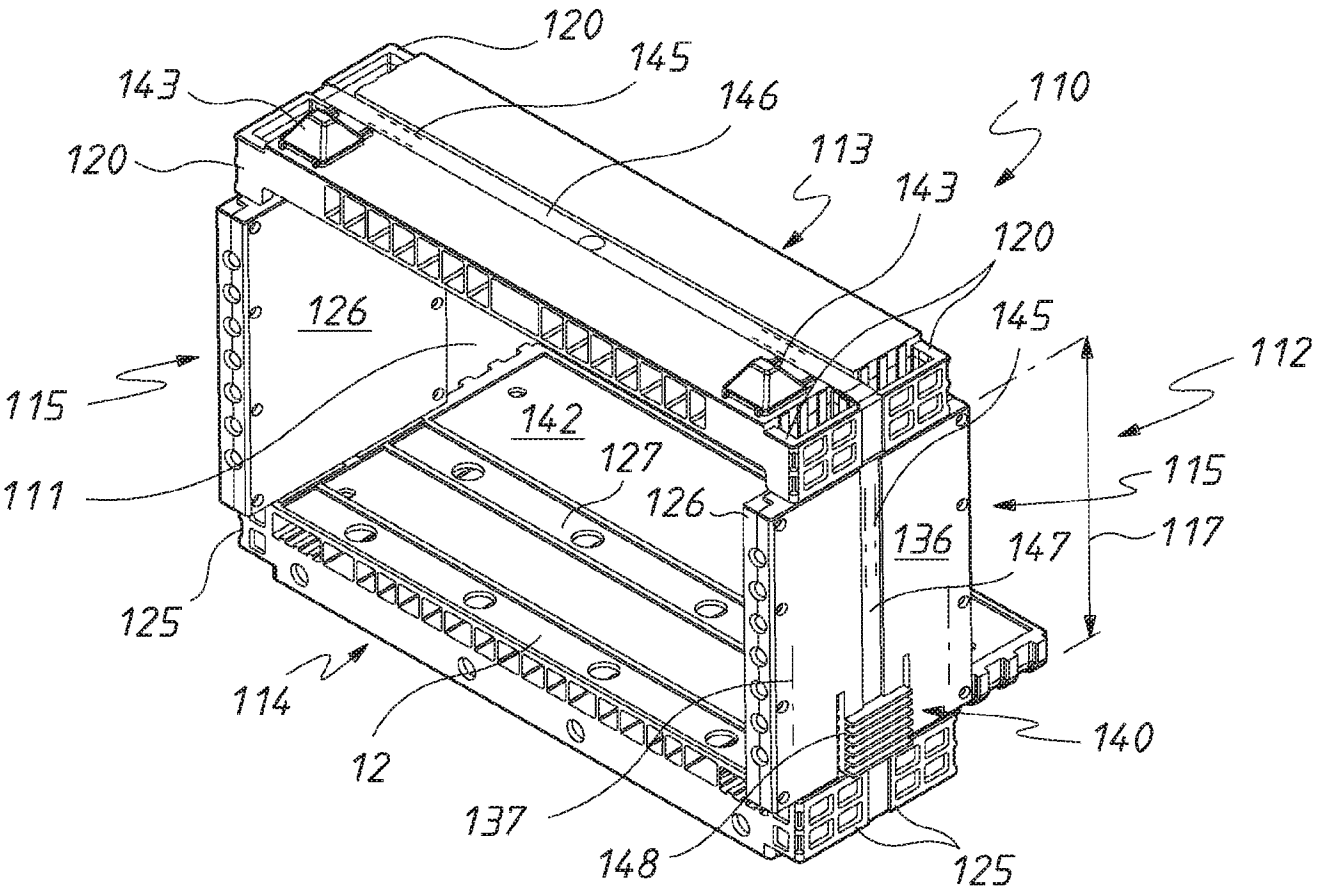
FIG. 18 is a schematic isometric view of a modification of the assembly of FIG. 13.
Figure 19:
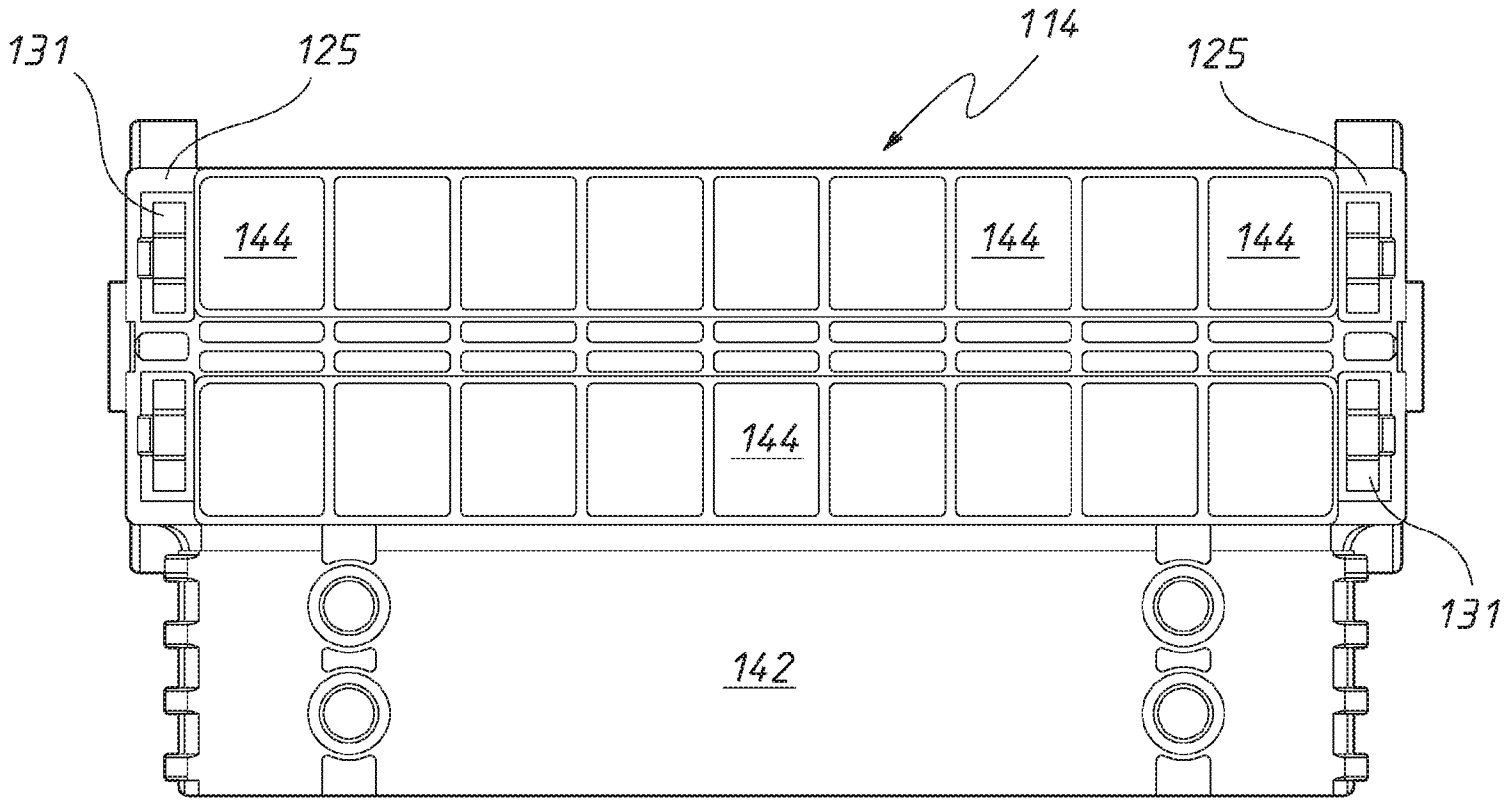
FIG. 19 is a schematic bottom plan view of the assembly of FIG. 18.
Figure 20:
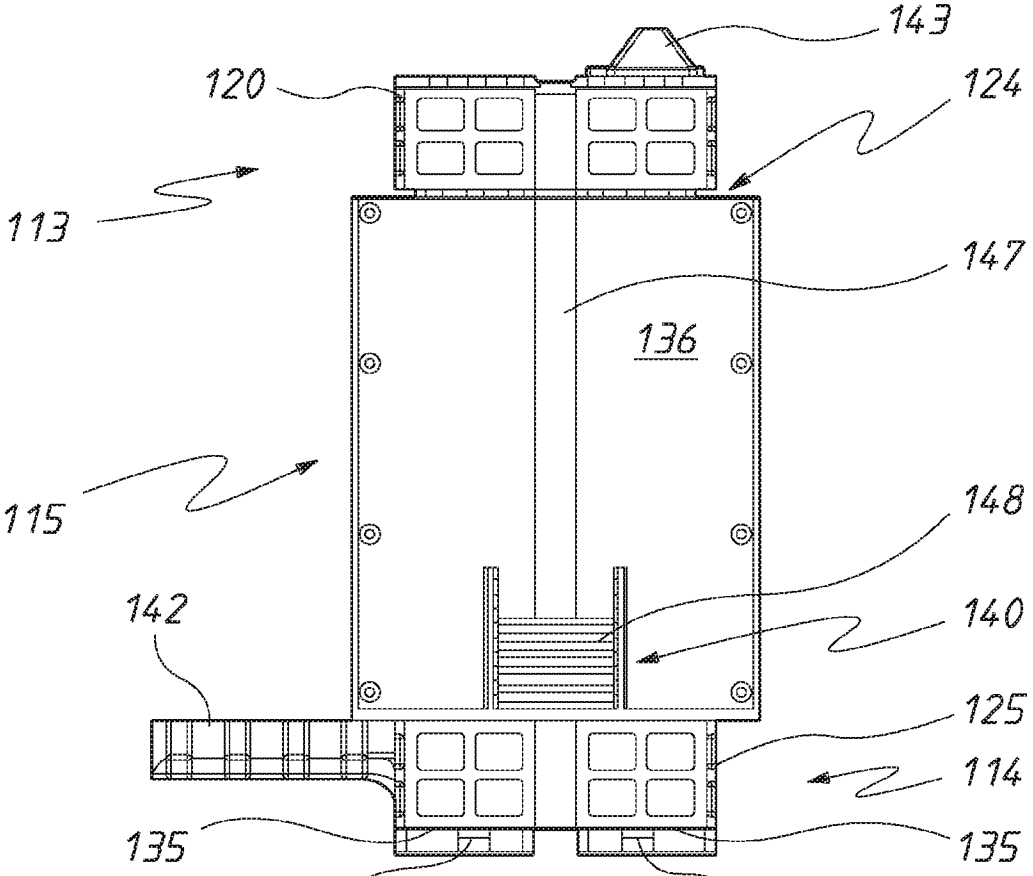
FIG. 20 is a schematic side elevation of the assembly of FIG. 18.
Figure 21:
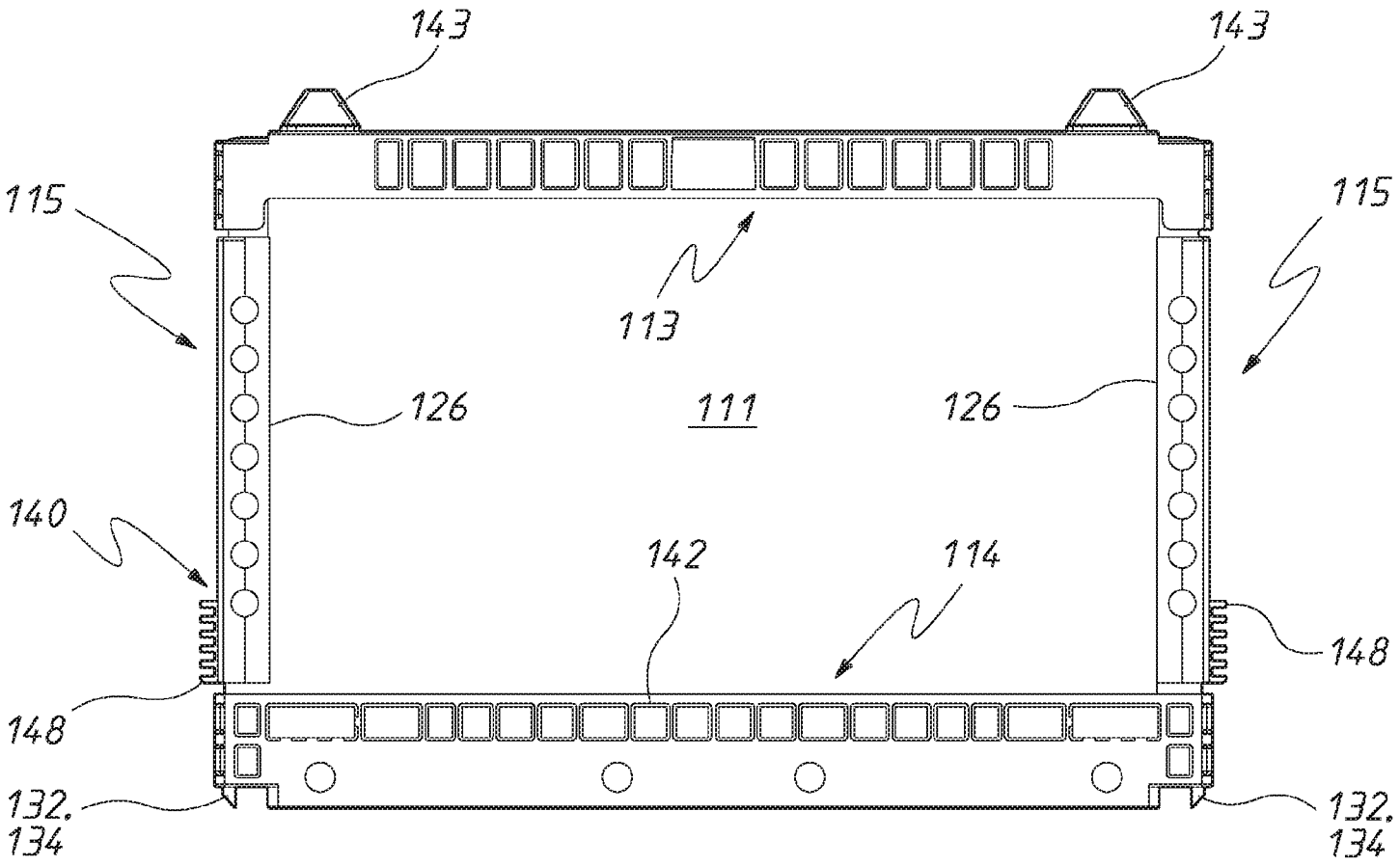
FIG. 21 is a schematic rear elevation of the assembly of FIG. 18.
Figure 22:
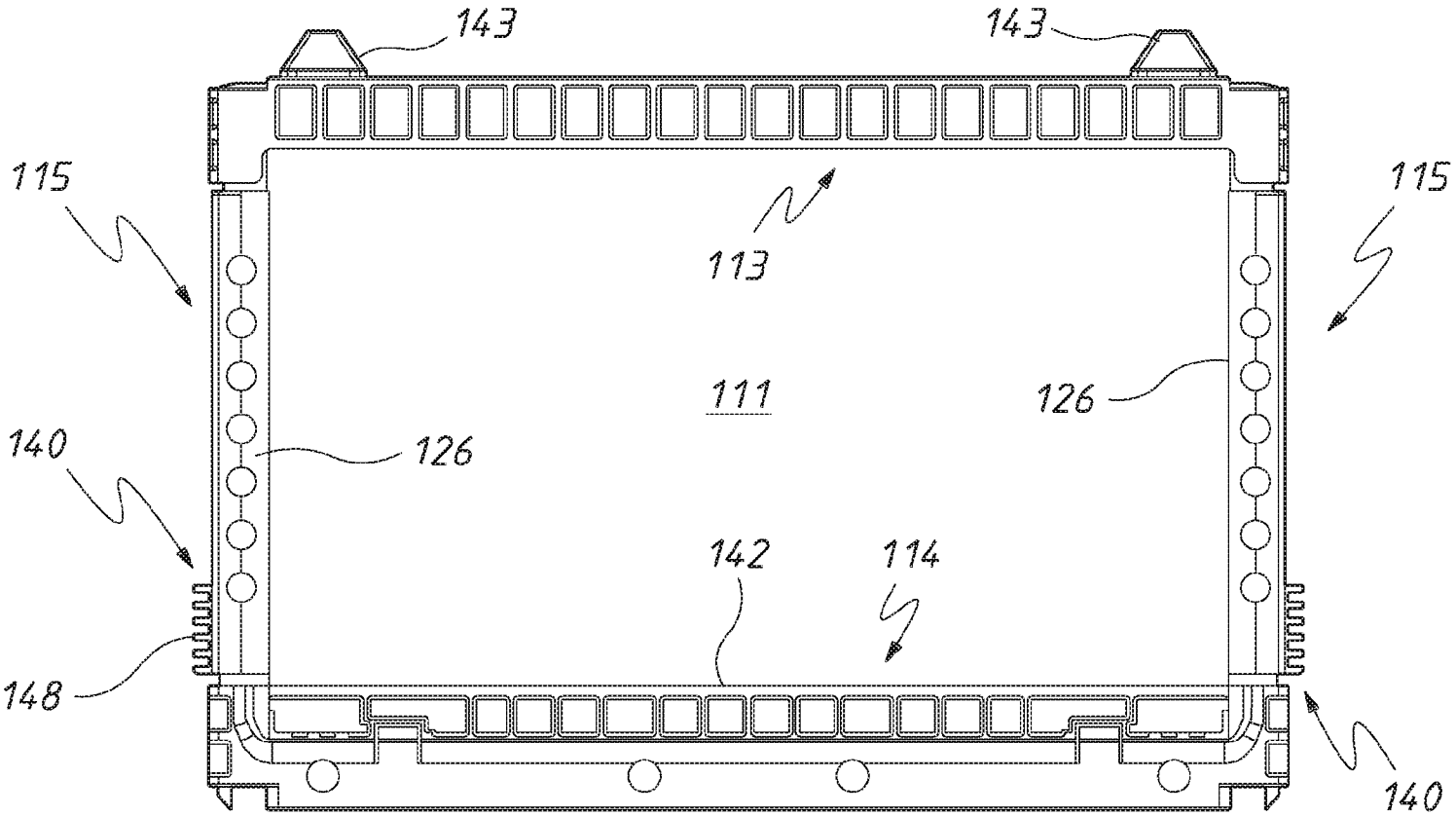
FIG. 22 is a schematic front elevation of the assembly of FIG. 18.
Figure 23:
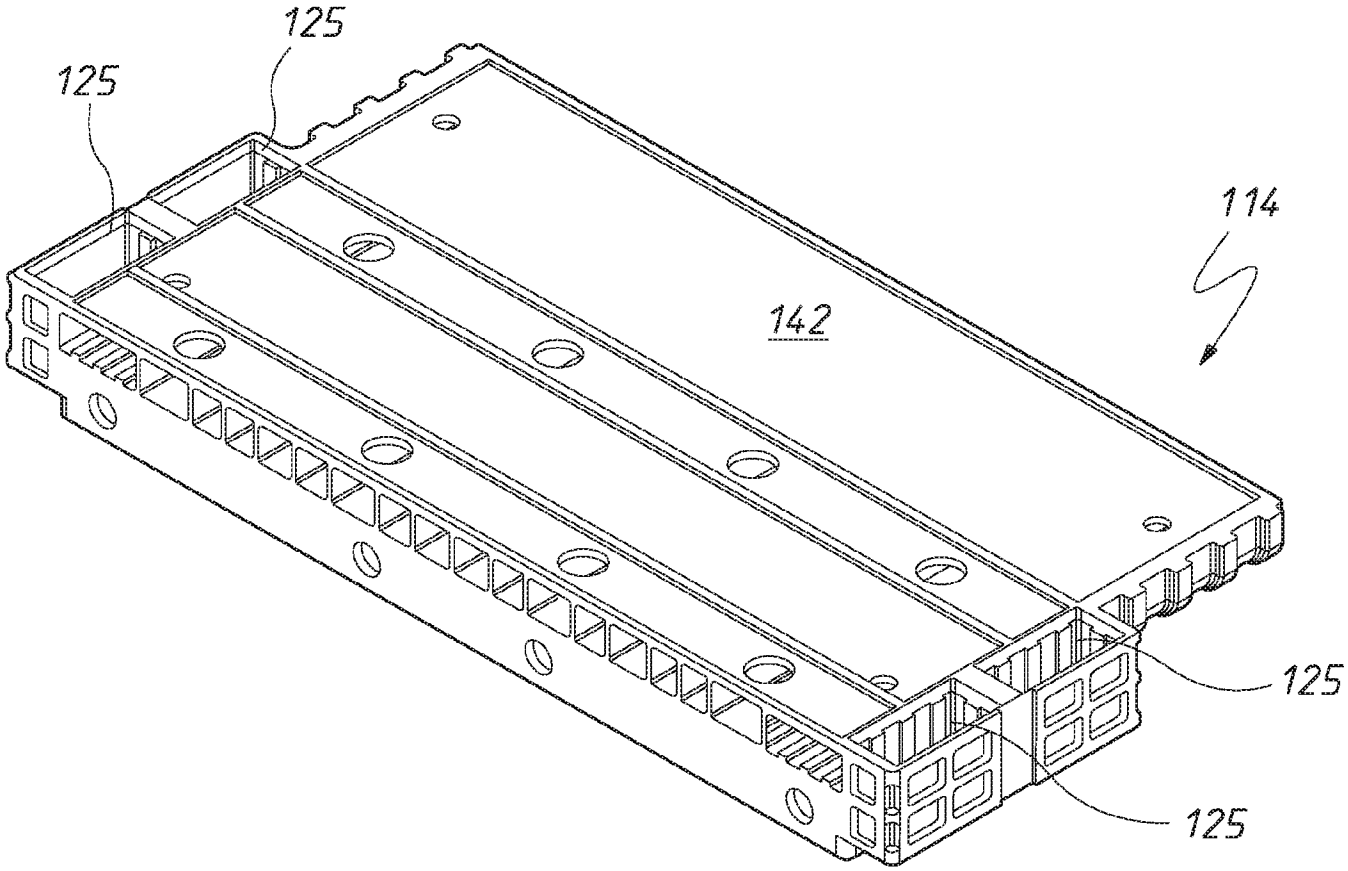
FIG. 23 is a schematic isometric view of the bottom cleat of the assembly of FIG. 18.
Figure 24:
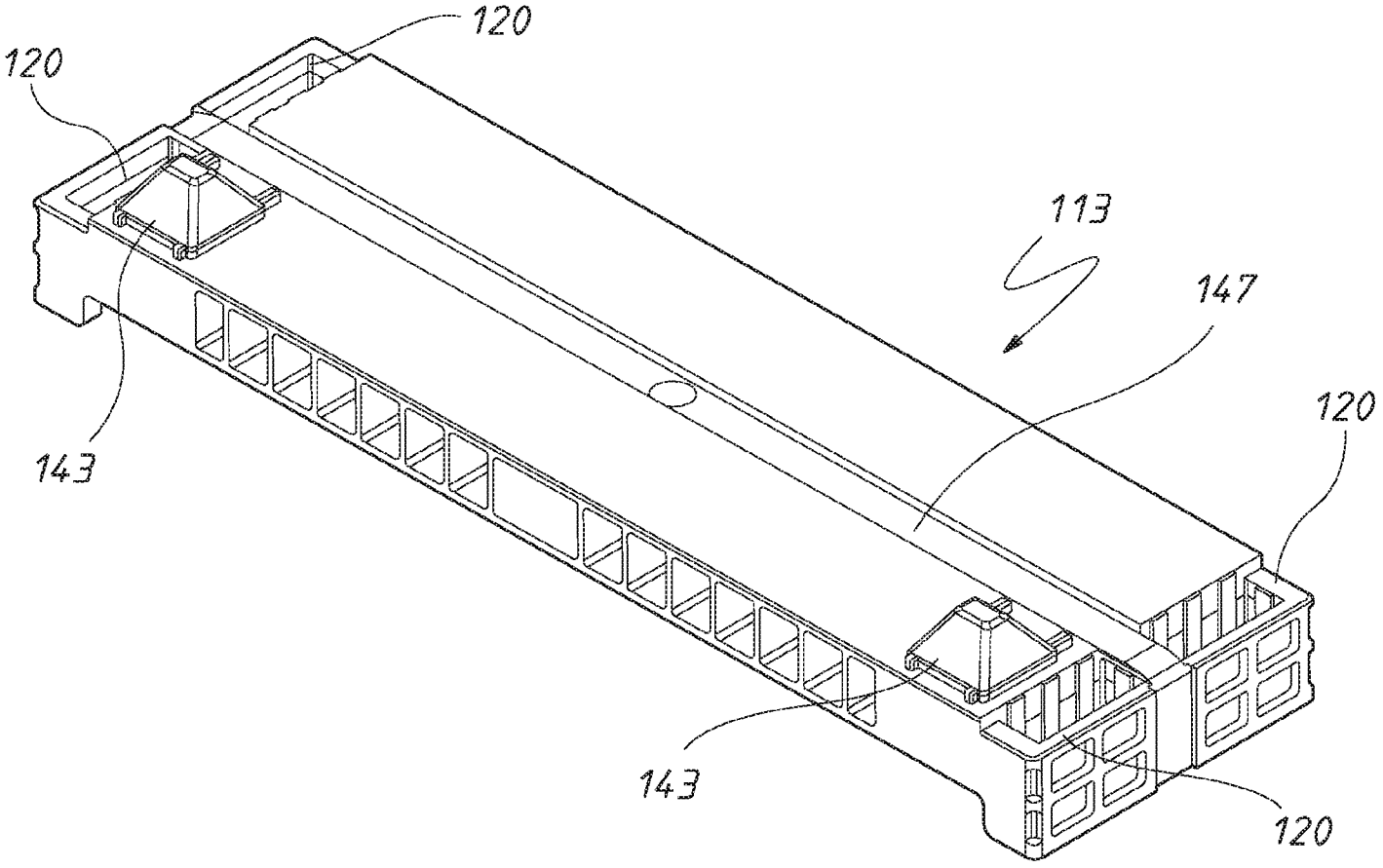
FIG. 24 is a schematic isometric view of the top cleat of the assembly of FIG. 18.
Figure 25:
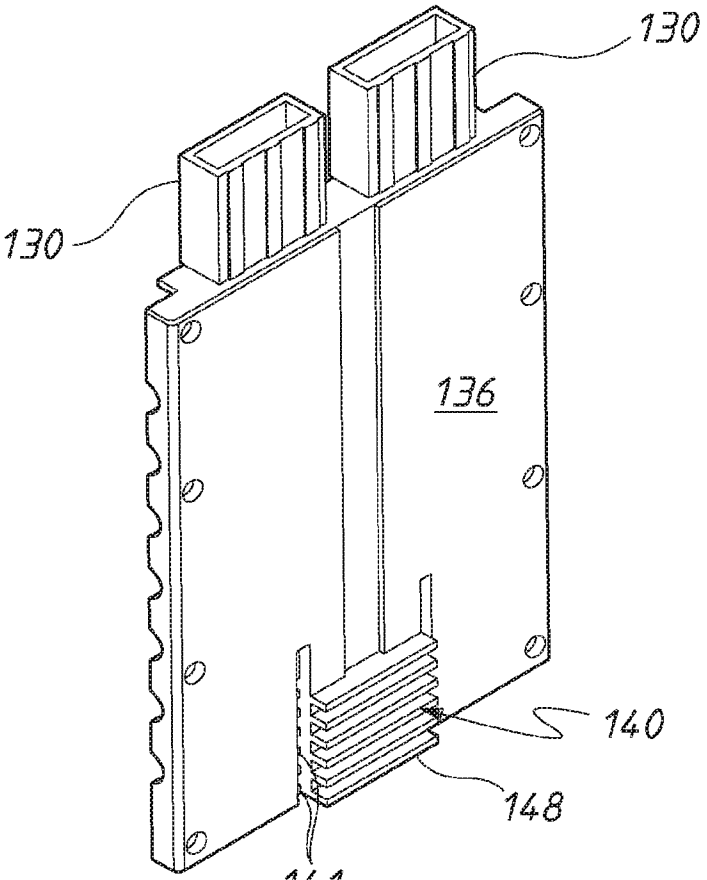
FIG. 25 is a schematic elevation of a side support outer half component of FIG. 18.
Figure 26:
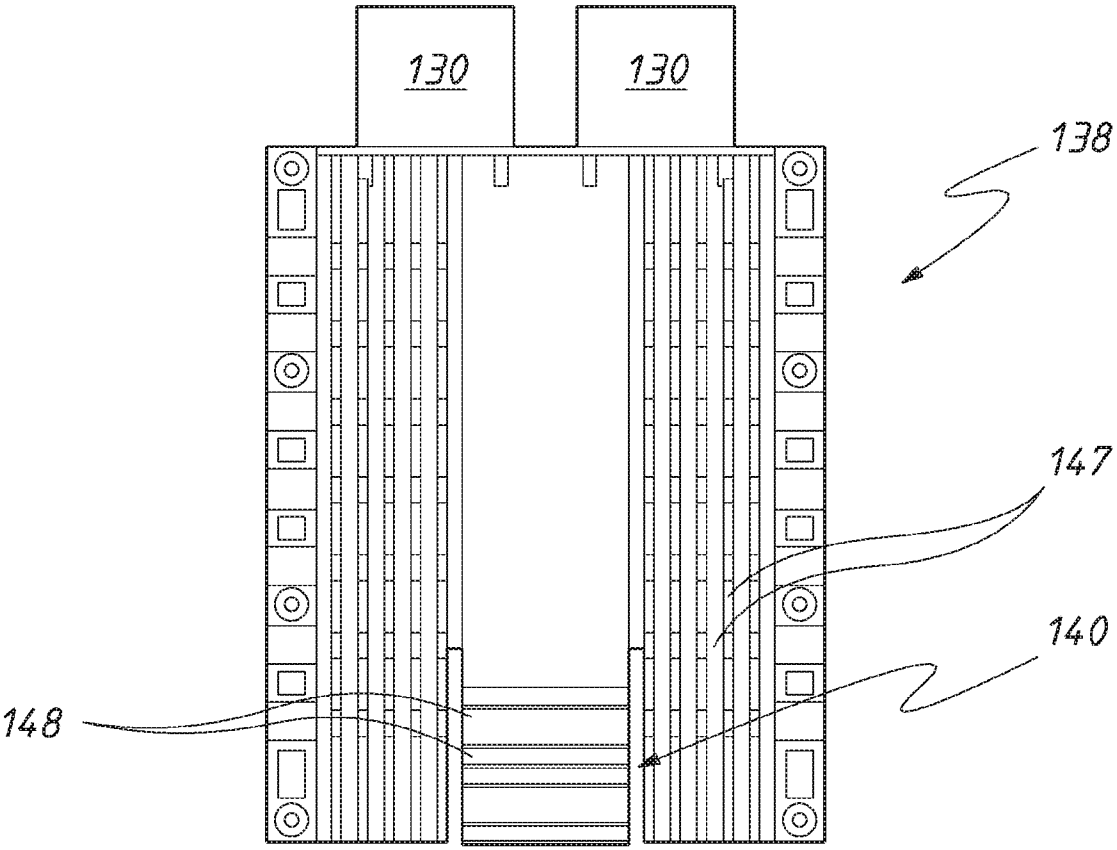
FIG. 26 is a schematic isometric view of portion of the side support of FIG. 18.
Figure 27:
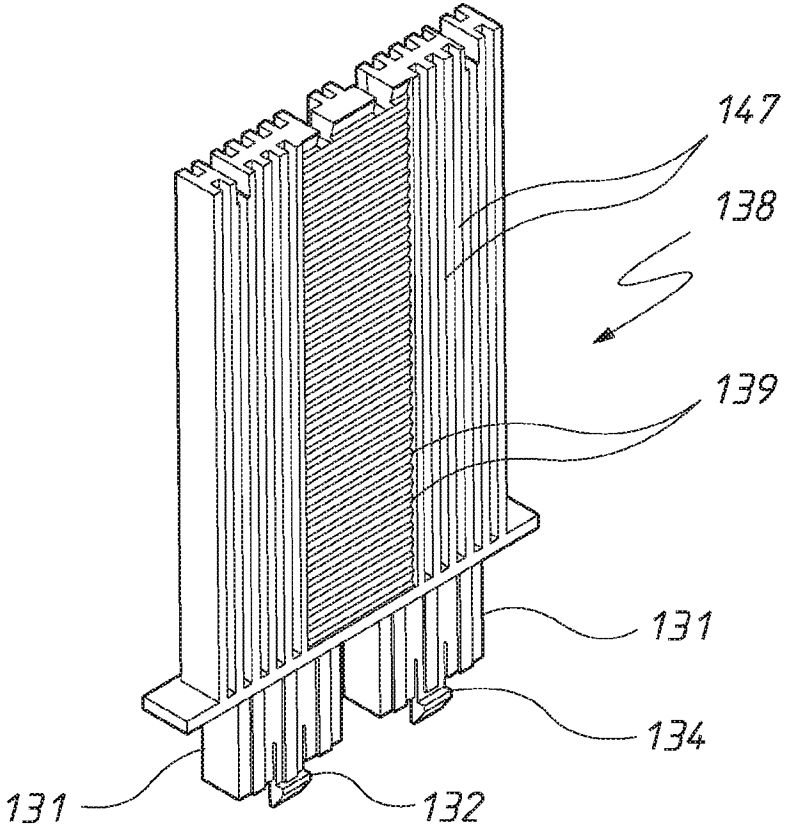
FIG. 27 is a schematic isometric view of a further side support portion of the support of FIG. 18.
Figure 28:
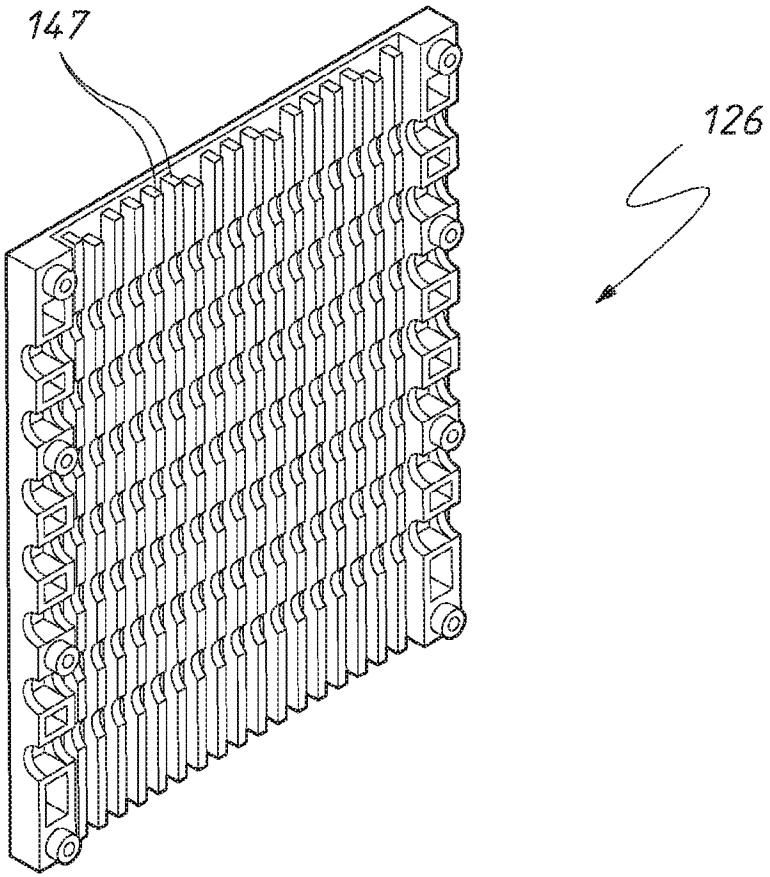
FIG. 28 is a bottom plan view of a side support's inner half component of the assembly of FIG. 18.

In the embodiment of FIG. 13, the projection 143 is generally central of the cleat 113. In the embodiment of FIG. 18, there are two projections 143, each adjacent a respective end extremity of the cleat 113, so as to be adjacent the sockets 120 and supports 115.

Preferably the cleats 113 and 114, and supports 115 are formed by being moulded of plastics material. Preferably the cleats 113 and 114 are each integrally formed.

Preferably, each pawl 140 is moulded integral with the remainder of its associated supporting base 136.

Preferably, each part 138 is integrally formed so as to have the pawls 132 and 134 integrally formed with the remainder of the part 138.

A particular advantage of the above described preferred embodiment is that the length (height) 117 is adjustable, to adjust to the height of the bundle to be transported by the assembly 110.

The invention claimed is:

1. A packaging assembly including:

an upper cleat;

a lower cleat;

a first and a second side support, each side support being formed separately to the upper cleat and lower cleat and detachable connected between the upper and lower cleats so that the upper cleat and lower cleat are spaced by a distance, with the cleats and side supports each having a planar configuration to provide a generally rectangular frame surrounding an aperture within which product to be transported is to be located; and wherein each of the first side support and the second side support have a lower sliding part and an upper sliding part, the lower sliding part having a receiving recess that receives the upper sliding part therein such that the lower sliding part and the upper sliding part are telescopically configured to move between an extended position wherein the upper sliding part projects from the receiving recess of the lower sliding part and a retracted position wherein the upper sliding part is substantially received within the receiving recess of the lower sliding part so as to provide adjustment of a longitudinal length of the first side support and the second side support that extends between the upper cleat and the lower cleat, the lower sliding part and the upper sliding part being lockable in position by a locking mechanism comprising a plurality of ratchet teeth and a resilient pawl, the resilient pawl configured to be urged into engagement with the ratchet teeth so that the distance between the upper cleat and the lower cleat is maintained.

2. The assembly of claim 1, wherein the resilient pawl, upon sufficient force being applied thereto, moves along the ratchet teeth to provide for adjustment of the distance between the upper and lower cleats.

3. The assembly of claim 1 wherein the packaging assembly includes a strap that passes about the upper cleat, lower cleat and first and second side supports, the strap able to be tensioned such that the tension engages with the resilient pawl of the first and second side supports with the ratchet teeth of the first and second side supports to retain the side supports fixed at a longitudinal length.

4. The assembly of claim 1 wherein the upper cleat and the lower cleat each have opposite end extremities, and each side support having an upper end extremity and a lower end extremity, with the end extremities providing projections and sockets so that each projection is received within a respective socket to secure the side supports to the cleats.

5. The assembly of claim 4 wherein the end extremity of the upper cleat and the lower cleat is provided with at least one of the sockets, and the end extremities of each side support is provided with one of the projections that are received within a respective one of the sockets.

6. The assembly of any one claim 4 wherein the upper cleat and the lower cleat each have opposite end extremities, and each side supports has an upper end extremity and a lower end extremity, with the end extremities providing projections and sockets so that each projection is received within a respective socket to secure the side supports to the cleats.

7. The assembly of claim 6 wherein each cleat end extremity is provided with at least one of the sockets, and each side supports end extremity is provided with one of the projections that are received within a respective one of the sockets.

8. The assembly of claim 4 wherein at least one of the projections includes a resilient pawl that releasably fixes at least one of side supports to an associated one of the cleats.

9. The assembly of claim 8 wherein each resilient pawl engages the lower cleat.

* * * * *